US007389962B2

(12) United States Patent
Rosiello

(10) Patent No.: US 7,389,962 B2
(45) Date of Patent: Jun. 24, 2008

(54) USER-ADJUSTABLE SUPPORT APPARATUS

(76) Inventor: Keith M. Rosiello, 32 Deerfield Rd., Shrewsbury, MA (US) 01545

( * ) Notice: Subject to any disclaimer, the term of this patent is extended or adjusted under 35 U.S.C. 154(b) by 217 days.

(21) Appl. No.: 10/920,893

(22) Filed: Aug. 18, 2004

(65) Prior Publication Data

US 2005/0103956 A1 May 19, 2005

Related U.S. Application Data

(60) Provisional application No. 60/496,091, filed on Aug. 18, 2003.

(51) Int. Cl.
*B43L 15/00* (2006.01)

(52) U.S. Cl. ..... 248/118.3; 248/346.01; 5/644; 5/654

(58) Field of Classification Search ..... 248/118.3, 248/346.01, 454; 5/449, 654, 644, 706, 711; 206/562
See application file for complete search history.

(56) References Cited

U.S. PATENT DOCUMENTS

| | | | | |
|---|---|---|---|---|
| 4,899,406 | A * | 2/1990 | Sanderson et al. | 5/655.3 |
| 4,967,992 | A * | 11/1990 | Menaged | 248/454 |
| 5,005,702 | A * | 4/1991 | Davis et al. | 206/562 |
| 5,568,907 | A * | 10/1996 | Wolfe et al. | 248/118 |
| 5,601,264 | A * | 2/1997 | Peart | 248/118.1 |
| 5,898,963 | A * | 5/1999 | Larson | 5/644 |
| 6,219,867 | B1 * | 4/2001 | Yates | 5/655.5 |
| 6,499,703 | B2 | 12/2002 | Chou | |
| 6,598,250 | B1 * | 7/2003 | Pekar | 5/654 |
| 2001/0054672 | A1 * | 12/2001 | de Beer | 248/118 |

FOREIGN PATENT DOCUMENTS

GB 2335025 A * 9/1999

* cited by examiner

*Primary Examiner*—Anita M King
(74) *Attorney, Agent, or Firm*—Foley & Lardner LLP; Michel Morency; James F. Ewing

(57) ABSTRACT

Methods and apparatus for use to relieve fatigue and or strain of the wrists, fingers, arms, and upper body due to repetitive motion or position. A support is provided comprised of an inflatable main support, a medium dispensing assembly, and a conduit assembly. The support's intended use is in conjunction with devices that require the user to maintain a position on a work surface, such as computer keyboards, pointing devices, and associated device pads. The support features an attached medium dispensing assembly and pressure release valve to allow the user repeatable inflation/deflation cycles and fine adjustments of the support inflation pressure.

13 Claims, 8 Drawing Sheets

USER-ADJUSTABLE SUPPORT APPARATUS

RELATED APPLICATION

This application claims priority to U.S.S.N. 60/496,091, filed Aug. 18, 2003, the entirety of which is hereby incorporated by reference in its entirety.

FIELD OF THE INVENTION

The present invention relates to ergonomic accessories used with computer devices.

BACKGROUND OF THE INVENTION

Modern computers use a variety of equipment to facilitate user input. Many common input devices (such as keyboards, pointing devices, and the like) rely upon interaction with the computer-user's fingers and hands. When using the input devices, the user's hands, arms and upper body are subject to stress and fatigue due to the general position and repetitive motion. An effective method of reducing stress and fatigue for device user is maintaining a position, with arms and hands slightly elevated from the main work surface, that minimizes pressure points and strain. Many rest and support devices assist a user in maintaining the proper elevated position, but all are limited in the amount of adjustment, or user-customization, that is offered.

Certain supports are constructed from a solid material, generally foam rubber, whose material properties give the support some flexibility. However, such a device is still solid in nature and maintains a singular, firm form when in use. This assists the user in maintaining the arms and hands in an elevated position, but may also create new pressure points and strains due to the unyielding solid material. Further, solid devices are mass-manufactured in fixed dimensions, so there is no customization available for an individual user's physical situation or equipment.

Flexible solid pouches filled with a fluid or semi-fluid (gel) material sealed inside provides another approach. Within the pouch, the displacement of the fluid or gel assists in dissipating pressure points while still aiding the user in maintaining an elevated position. The fluid or gel displacement within the pouch offers a small range of individual adjustment for users. Although these fluid or gel filled supports improve the comfort level of the user, material and manufacturing is costly and the final product is heavy.

SUMMARY OF THE INVENTION

In accordance with the present invention there is disclosed an ergonomic device for use with computer accessories, that is customizable and comfortable. The apparatus has a substantially planar surface, a main support adapted to the substantially planar surface including an exterior and interior surface, a medium dispensing assembly in communication with the main support, and a first and a second one-way conduit. The first one-way conduit extends through both surfaces of the main support and is user-adjustable. The second one-way conduit has an outlet end that extends through both surfaces of the main support and an inlet end which extends within the medium dispensing assembly. The main support and the medium dispensing assembly are constructed from a flexible material, therefore allowing for expansion and compression. The medium dispensing assembly includes a return mechanism also constructed from a flexible material and includes vents to the atmosphere that allow for further user controlled adjustability.

In another aspect of the invention, the apparatus includes a first substantially planar surface that can act as a base, a second substantially planar surface, a main support adapted to the first substantially planar surface including an exterior and interior surface, a medium dispensing assembly in communication with the main support, and a first and a second one-way conduit. The first one-way conduit extends through both surfaces of the main support and is user-adjustable. The second one-way conduit has an outlet end that extends through both surfaces of the main support and an inlet end which extends within the medium dispensing assembly. In one embodiment, the medium dispensing assembly is constructed from a flexible material and thus provides a return mechanism. The return mechanism is constructed from a compressible and expandable material and the solid medium dispensing assembly comprises a separate compression device and return component.

In yet another aspect, the invention provides for methods of supporting the wrist of a computer user by providing to the user an apparatus further including a substantially planar surface; a main support adapted to the substantially planar surface, the main support having an exterior and interior surface wherein the interior surface defines a lumen; a medium dispensing assembly in communication with the main support; a first one-way conduit and a second one-way conduit, wherein the first one-way conduit extends through the exterior and interior surfaces of the main support and is user-adjustable, and the second one-way conduit wherein the outlet of the second one-way conduit extends through the exterior and interior surfaces of the main support and the inlet of the second one-way conduit extends within the medium dispensing assembly, wherein the wrist of the user is supported during manipulation of computer peripheral accessories.

In still other aspects, the invention provides methods of preventing and alleviating repetitive injury to the wrist of a computer user by providing to the user an apparatus further including a substantially planar surface; a main support adapted to the substantially planar surface, the main support having an exterior and interior surface wherein the interior surface defines a lumen; a medium dispensing assembly in communication with the main support; a first one-way conduit and a second one-way conduit, wherein the first one-way conduit extends through the exterior and interior surfaces of the main support and is user-adjustable, and the second one-way conduit wherein the outlet of the second one-way conduit extends through the exterior and interior surfaces of the main support and the inlet of the second one-way conduit extends within the medium dispensing assembly, wherein the wrist of the user is supported during manipulation of computer peripheral accessories and repetitive motion injuries are thereby prevented or alleviated. In one embodiment, the repetitive motion injury includes strain to the median nerves of the hand. In another embodiment, the repetitive motion injury includes prevention and alleviation of carpel tunnel syndrome.

Other advantages, characteristics, and features of the present invention and the organization of parts and economies of manufacture, will become apparent upon consideration of the following detailed description with reference to the accompanying drawings, the latter of which is briefly described herein below.

DETAILED DESCRIPTION OF THE INVENTION

The present invention provides a user adjustable apparatus that assists computer input device users in maintaining their wrists and hands in an elevated position during operation of keyboards and pointing peripheral devices, to reduce fatigue and pressure points due to repetitive motion or position. The apparatus improves upon prior devices by allowing a full range of available adjustments for individual user and equipment situations. The apparatus has a main support that is inflated, for example by manual actuation of an attached medium dispensing assembly via a one-way conduit. In a currently preferred embodiment, the medium dispensing assembly is an air pump and the medium dispensed is air. While the preferred medium for the embodiments is air, the medium dispensing assembly can be inflated with any gas, such as inert gases, or liquids such as water, and or semi-liquids such as gels. The support chamber is deflated by means of a release one-way valve or conduit to allow for repeat adjustment to accommodate different users or situations. The apparatus is simple in design and construction, easy to use, and inexpensive to manufacture.

Figure 1:
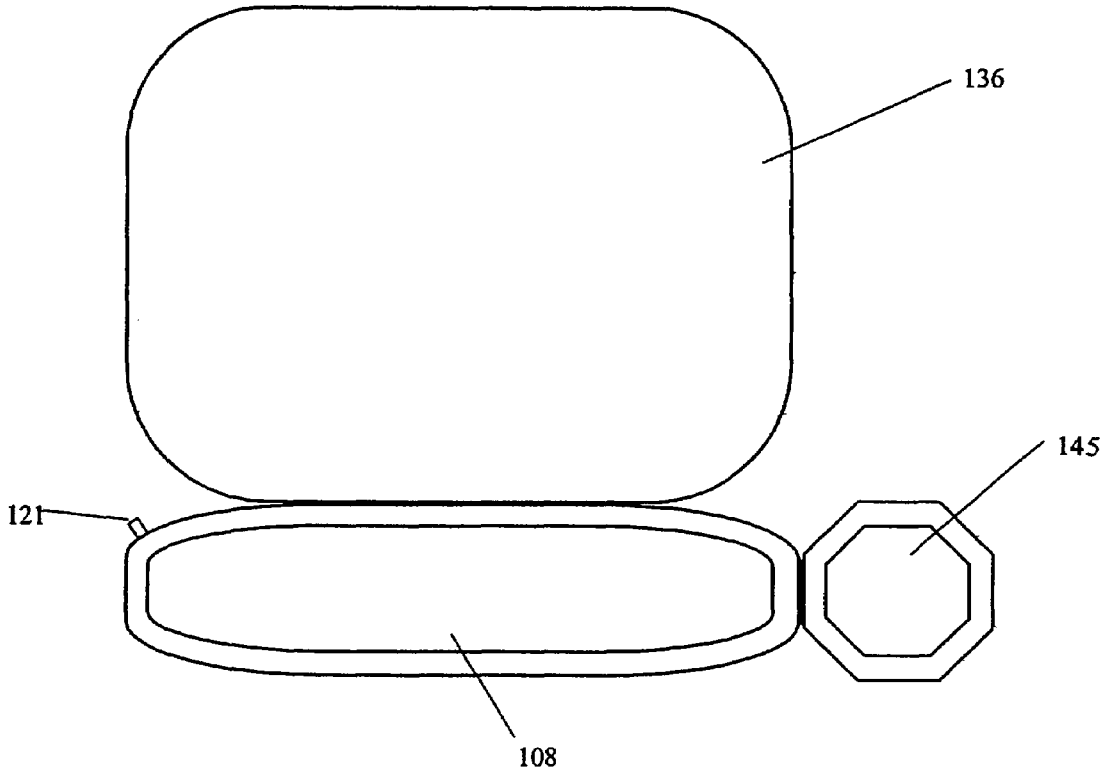
FIG. 1 is a perspective schematic view of a preferred embodiment of the device.

Referring to FIG. 1, a substantially planar surface (136), generally referred to as a mouse pad, is physically attached to the main support (108) which is constructed from a thin, flexible polymer material that is formed into a sealed chamber using commonly-known manufacturing techniques, such as heat sealing or sonic welding. A manually activated, miniature first one-way conduit (121) such as a valve is mounted through the surface of the main support chamber to allow the user to deflate the main support chamber as personally desired. The main support is positioned with respect to the substantially planar surface such that it offers the greatest amount of support to the user's hands and wrists while operating a computer device such as a mouse or keyboard. In the preferred embodiment, the medium dispensing assembly (145) is constructed of thin, flexible polymer material that is formed into a sealed chamber containing one or more components that provide a return mechanism for the medium dispensing assembly that returns the medium dispensing assembly to a pre-actuated shape after loading. The components of the return mechanism are constructed from a highly compressible material that expands when the load is released, such as memory foam. The medium dispensing assembly also includes vents from its interior to the outside atmosphere to allow air to flow into the medium dispensing assembly after actuation and upon release of load. The medium dispensing assembly is attached to the main support using commonly-known manufacturing techniques, or can be located distally when using a conduit or other mechanism to channel and introduce the medium from the medium flow device to the support. When the two are connected, a one-way conduit is inserted and sealed into the medium dispensing assembly, which has an outlet end that is inserted and sealed through the wall of the main support and the inlet end of the conduit. In the preferred embodiment, the second one-way conduit is contained within the joint that connects the main support and the medium dispensing assembly. Medium, for example, air from the atmosphere, is drawn into the pump assembly and forced through the connecting conduit into the main support. As the user continues to actuate the medium dispensing assembly, the main support chamber increases support force.

Figure 2:
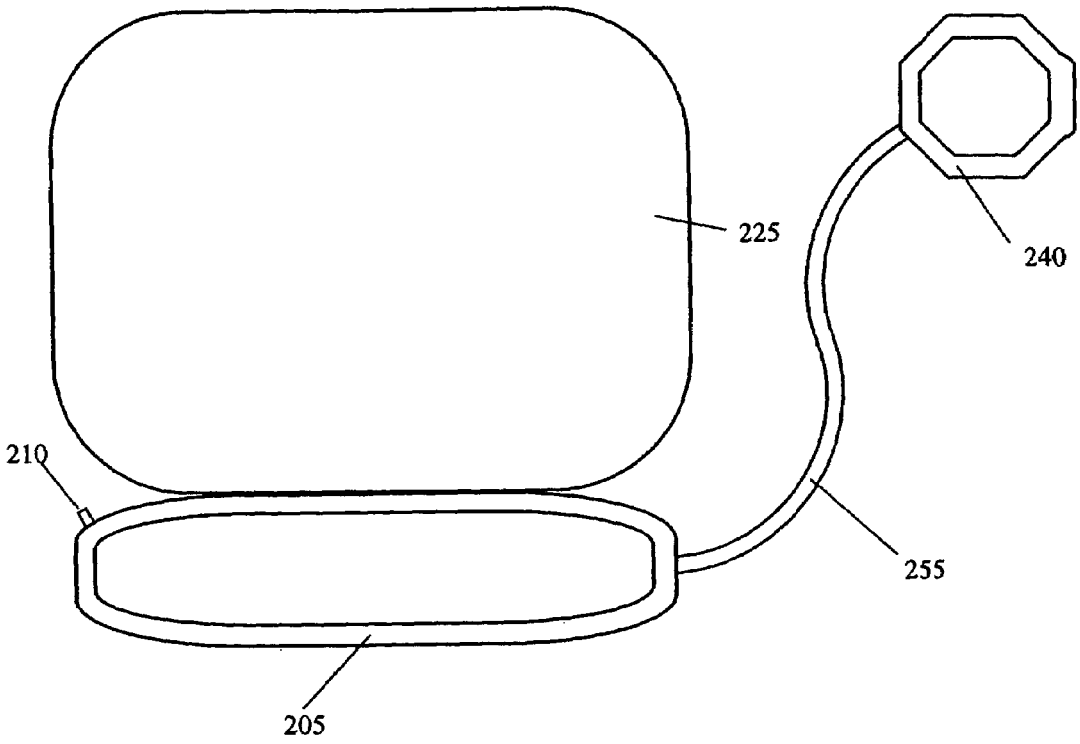
FIG. 2 is a perspective schematic view of another embodiment in which the medium dispensing assembly is connected to the main support via an extended second conduit.

As shown in FIG. 2, the main support chamber (205) is constructed from a thin, flexible polymer material that is formed into a sealed chamber using one of many commonly-known manufacturing techniques, such as heat sealing, or ultrasonic welding. A manually activated, miniature one-way conduit (210) such as a valve is mounted through one surface of the main support chamber to allow the user to deflate the other embodiment as personally desired. The main support is positioned with respect to the substantially planar surface (225) such that it offers the most comfort and support for the user. The medium dispensing assembly (240) is constructed from a thin, flexible material flexible material, formed into a sealed chamber. The interior of the medium dispensing chamber contains one or more components that form a return mechanism for the medium dispensing assembly. These components of the return mechanism are constructed from a highly compressible material that expands when the load is released, such as memory foam. The medium dispensing assembly contains vents from the interior of the assembly to the exterior atmosphere. In this embodiment, the long flexible second one-way conduit (255) has an outlet end which is inserted and sealed through the wall of the main support and the inlet end is inserted and sealed into the medium dispensing assembly. The longer second one-way conduit allows the medium dispensing assembly to remain freestanding and the length of the conduit is the only limitation to the medium dispensing assembly's placement and location. Medium such as air from the atmosphere is drawn into the medium dispensing assembly and forced through the connecting conduit into the main support. As the user continues to actuate the medium dispensing assembly, the main support chamber increases the level of support.

Figure 2A:
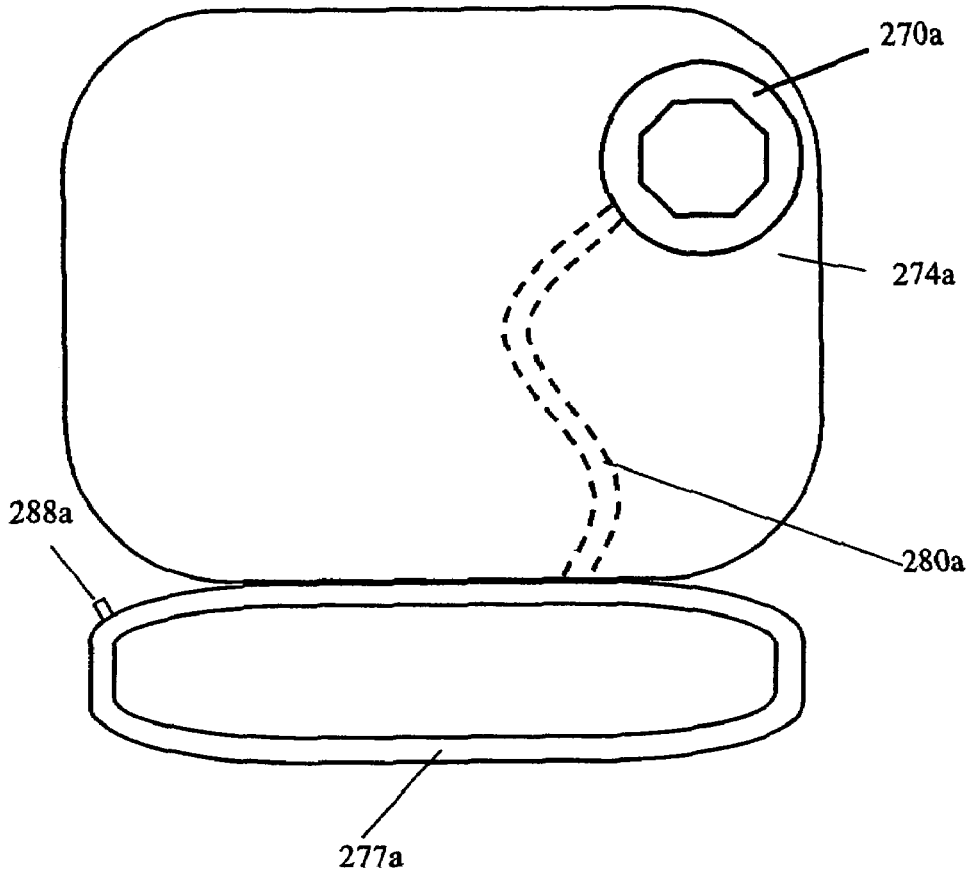
FIG. 2*a* is a perspective schematic view of another embodiment in which the main components, including an extended second conduit, are mounted to a first substantially planar surface.

As shown in FIG. 2*a* the medium dispensing assembly (270*a*) is contained by the substantially planar surface (274*a*) in a remote position with respect to the main support chamber (277*a*). An extended second one way conduit (280*a*), also contained by the substantially planar surface, has an inlet end inserted and sealed into the remote medium dispensing assembly and an outlet end inserted and sealed into the to the main support chamber. A manually actuated, miniature first one-way conduit (288*a*) is mounted through the surface of the main support chamber to allow the user to adjust the settings of support chamber as personally desired.

Figure 3:
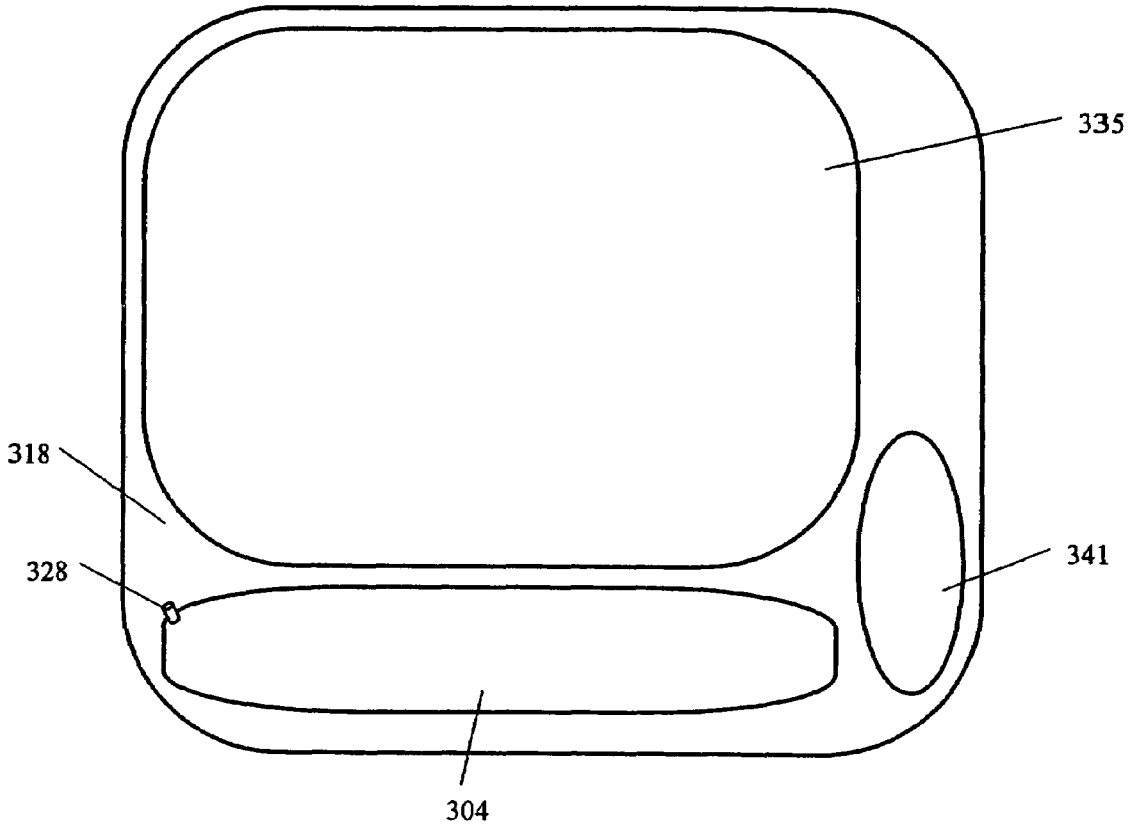
FIG. 3 is a perspective schematic view of another embodiment in which the main components are all mounted to a first substantially planar surface.

As shown in FIG. 3, the main support chamber (304) is constructed from a thin, flexible material, for example, a polymer, that is formed into a sealed chamber and mounted to a first substantially planar surface. The first substantially planar surface (318) is constructed from a typical solid or semi-solid substantially rigid material and contains geometric features for the second substantially planar surface (335), the main support chamber, the medium dispensing assembly (341), and associated one way conduits. The main support chamber is mounted on the first substantially planar surface proximate to the pocket intended to hold peripheral computer devices, such as keyboards or technical pointing devices like trackball or touchpad. A manually actuated, miniature first one-way conduit (328) is mounted through the surface of the main support chamber to allow the user to adjust the settings of support chamber as personally desired. This third embodiment has a medium dispensing assembly constructed of a thin, flexible polymer material that is formed into a sealed chamber containing one or more components that provide a return mechanism, constructed from a highly compressible and expandable material, such as memory foam. The medium dispensing assembly contains vents from its interior to the exterior atmosphere. The medium dispensing assembly is approximately one-quarter the size of the main support chamber and is mounted to the first substantially planar surface proximate to the main support chamber. The outlet end of the second one-way conduit is inserted and sealed into the main support chamber and the inlet end of the one-way conduit is inserted and sealed within the medium dispensing assembly. The second one-way conduit is contained within features of the first substantially planar surface. The medium (e.g., air from the atmosphere) is drawn into the medium dispensing assembly and forced through the connecting conduit and into the main support chamber. As the user continues to actuate the medium dispensing assembly, the main support chamber expands and thereby increases the level of support.

Figure 4:
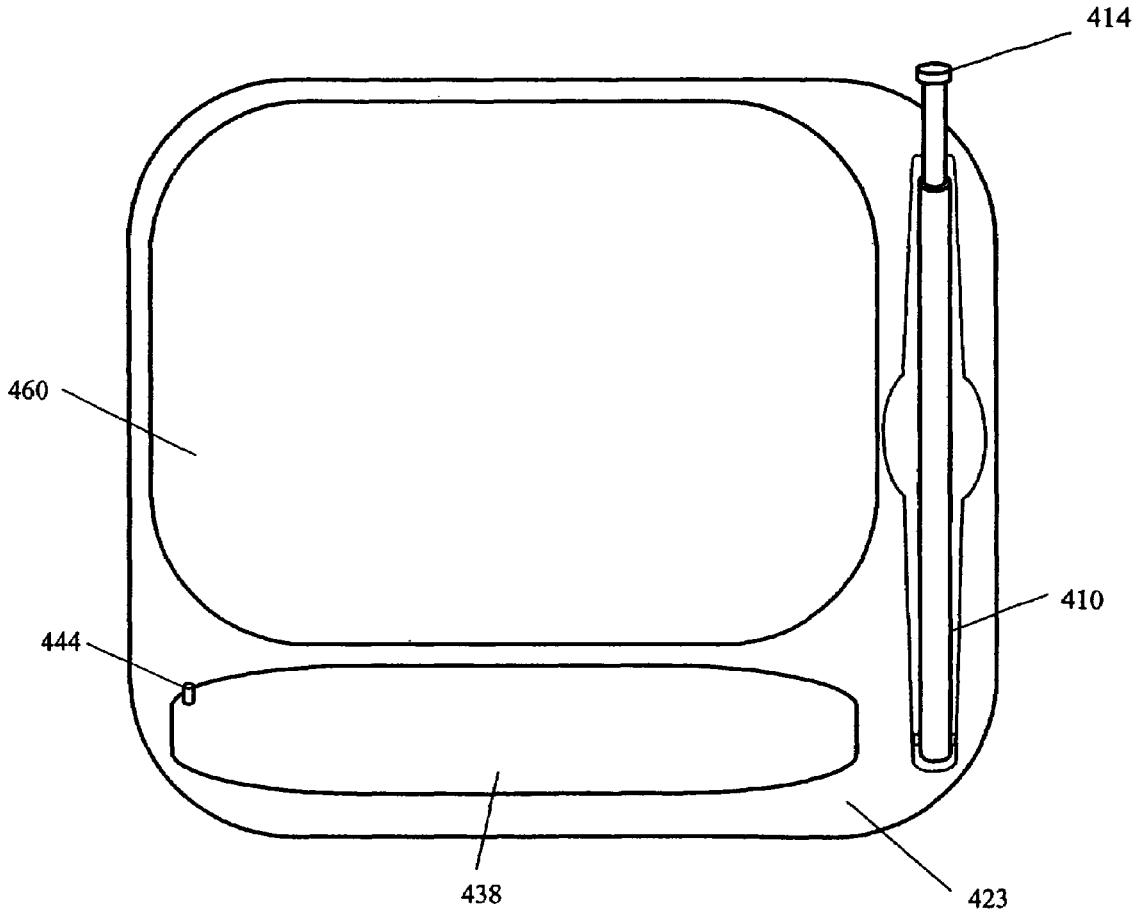
FIG. 4 is a perspective schematic view of another embodiment in which the main components are all mounted to a first substantially planar surface and the medium dispensing assembly is a compact, low-profile, design.

As shown in FIG. 4 the medium dispensing assembly (410) is constructed from a solid tubular material that contains an interior chamber vented to the atmosphere, a compression shaft (414) and a typical return component, such as a spring. The medium dispensing assembly is connected to the first substantially planar surface (423) in a recessed feature. A common fastener that allows rotation in one direction, such as a hinge or pin, is used to attach the medium dispensing assembly. The medium dispensing assembly rotates around the fastener and out of the recessed feature for the user to actuate the compression shaft. The first substantially planar surface is constructed from a typical solid or semi-solid substantially rigid material and also contains geometric features for the second substantially planar surface (460), the main support chamber, and the medium dispensing assembly. A manually actuated, miniature first one-way conduit (444) is mounted through the surface of the main support chamber to allow the user to adjust the settings of support chamber as personally desired. The outlet end of the second one-way conduit is inserted and sealed in the main support chamber (438) and the inlet end is inserted and sealed into the medium dispensing assembly. The second one-way conduit is contained within features of the first substantially planar surface. Air from the atmosphere is drawn into the medium dispensing assembly and forced through the connecting conduit into the main support chamber. As the user continues to actuate the medium dispensing assembly, the main support chamber increases the level of support.

Figure 5:
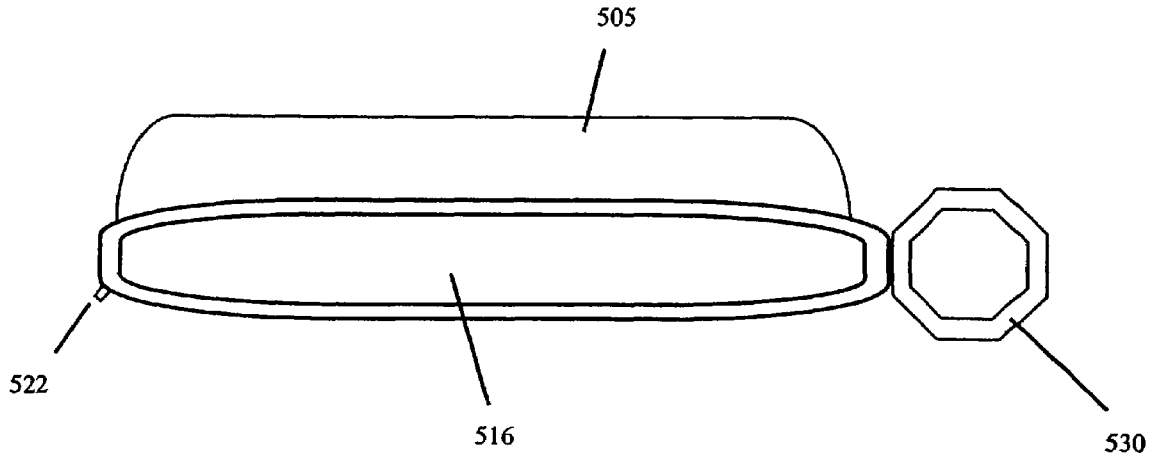
FIG. 5 is a perspective schematic view of another embodiment in which the main support is sized to accommodate a computer keyboard or keypad.

In FIG. 5 the first substantially planar surface (505) has a different shape to it, allowing for other technical devices to adopt the support system, such as a keyboard or keypad, to provide elevated wrist and hand support for the user. The dimensions of the main support chamber (516) are designed to reflect the typical keyboard or keypad sizes and styles. The main support chamber (516) is positioned with respect to the first substantially planar surface (505) such that it offers the user the most support possible in which to operate the technical device. Similar to the embodiment shown in FIG. 1. a miniature first one-way conduit (822) and a medium dispensing assembly (530) are also provided.

Figure 6:
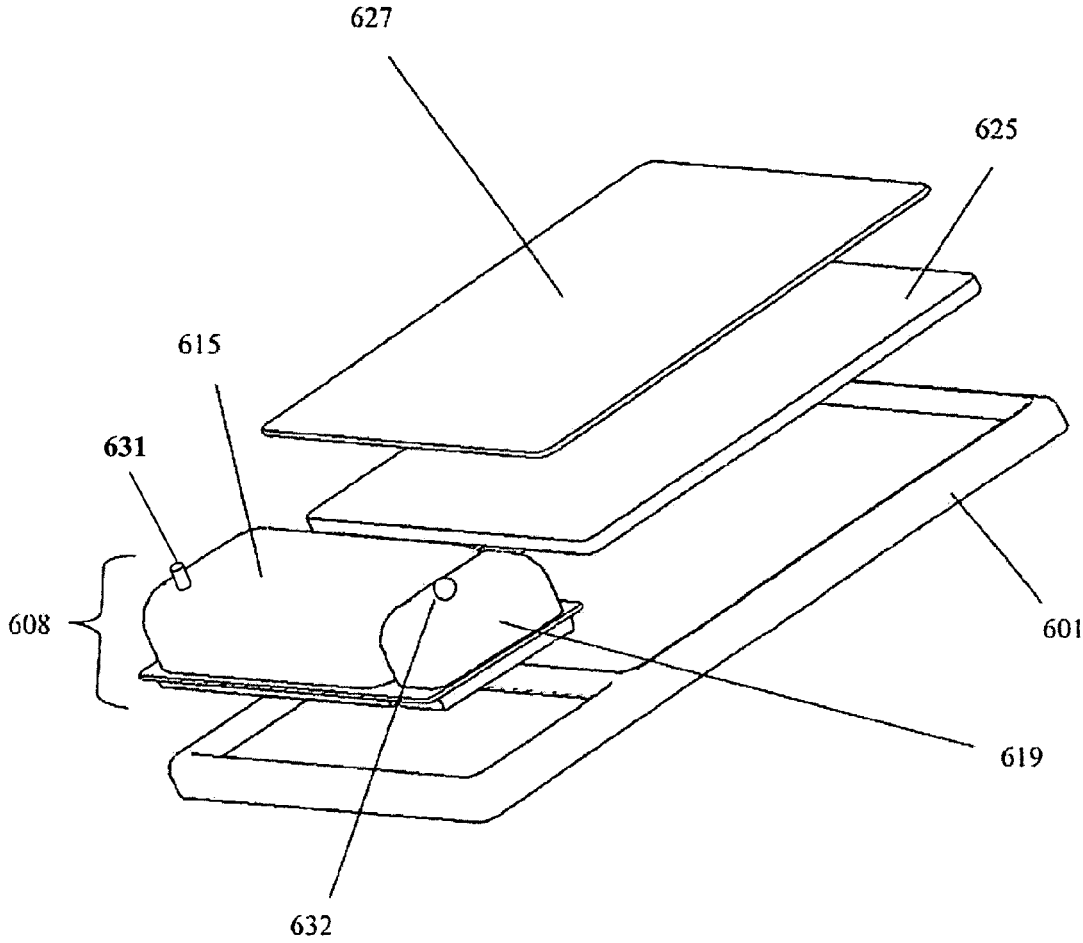
FIG. 6 is a perspective schematic view of the preferred manufacturing embodiment.
Figure 6A:
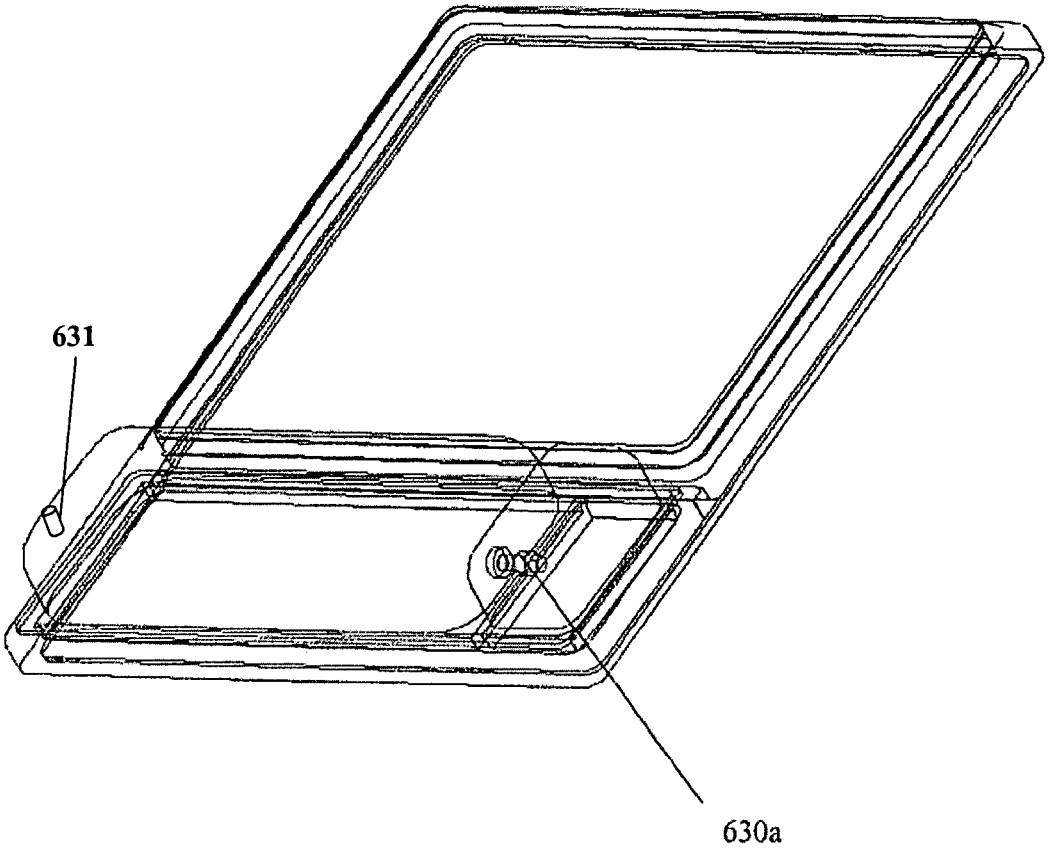
FIG. 6*a* is a perspective schematic view of the second one way conduit in the preferred manufacturing embodiment.

In FIG. 6 the preferred manufacturing embodiment, which is optimized for efficient, high volume material forming and assembly processes, is shown. In this embodiment, the first substantially planar surface (601) is constructed from a typical mold-formed, thin walled solid material, such as polyethylene. The first substantially planar surface contains geometric features, which supply locations for mounting or sealing other components, and offer positive alignment for automated assembly processes. The main support chamber and medium dispensing unit (608) are constructed from a thin, flexible material, for example, a polymer, that is formed into two sealed chambers and mounted with a geometric feature of the first substantially planar surface. The support chamber and medium dispensing unit is functions if mounted to the first substantially planar surface with the main support chamber (615) on the left side or right side. A manually actuated, miniature first one-way conduit (631) is mounted through the surface of the main support chamber to allow the user to adjust the settings of support chamber as personally desired. As shown in FIG. 6*a*, the second one-way miniature conduit (630*a*) is contained within the common seal between the main support and the medium dispensing assembly (619). The medium dispensing assembly contains a return mechanism and vent (632). The second substantially planar surface (625) and second substantially planar surface cover (627) are fastened or adhered within a feature of the first substantially planar surface.

While the preferred medium for the embodiments is air, the medium dispensing assembly can be inflated with any gas, such as inert gases, or liquids such as water, and or semi-liquids such as gels. Different assemblies of the return component can allow for the supply of various mediums. Where the medium supplied to the support is not ordinary air, it is desirable to contain the medium and thus conserve it. Accordingly, a reservoir can be adapted to the apparatus to supply medium to the support and to contain medium vented from the support. Furthermore, one of ordinary skill in the art will appreciate the various embodiments of the disclosed invention, and will understand that the variety of forms of computer peripheral devices, such as keypads, digital or optical input devices, and infrared devices that require interaction with the user's hands and fingers can be adapted to fit the apparatus.

The invention described has application in preventing repetitive motion injuries to the hand and wrist, for example strain injury to the median nerves of the hand and wrist associated with carpel tunnel syndrome, of a user of computer peripherals, such as a mouse. In other embodiments, the invention alleviates the pain and irritation to the nerves in the hands and wrists of a user suffering from such repetitive motion disorders, as it is ergonomic, and reduces the pressure points on the carpel tunnel as well as strain on the nerves.

Equivalents

From the foregoing detailed description of the invention, it should be apparent that a unique support device has been described resulting in improved comfort for users of computer devices. Although particular embodiments have been disclosed herein in detail, this has been done by way of example for purposes of illustration only, and is not intended to be limiting with respect to the scope of the appended claims which follow. In particular, it is contemplated by the inventor that substitutions, alterations, and modifications may be made to the invention without departing from the spirit and scope of the invention as defined by the claims. For instance, the choice of materials, is believed to be matter of routine for a person of ordinary skill in the art with knowledge of the embodiments described herein.

What is claimed is:

1. An apparatus comprising:

a first substantially planar surface and a second substantially planar surface wherein the second substantially planar surface is adapted to the first substantially planar surface;

a main support adapted to the first substantially planar surface, the main support having an exterior surface and an interior surface wherein the interior surface defines a lumen;

a medium dispensing assembly in communication with the main support;

a first one-way conduit; and a second one-way conduit, wherein the first one-way conduit is user-adjustable and extends through the exterior and interior surfaces of the main support, and wherein an outlet of the second one-way conduit extends through the exterior and interior surfaces of the main support and an inlet of the second one-way conduit extends within the medium dispensing assembly.

2. The apparatus of claim 1 wherein the first substantially planar surface comprises a solid material.

3. The apparatus of claim 1 wherein the first substantially planar surface comprises geometric features for the second substantially planar surface, the main support, and the medium dispensing assembly.

4. The apparatus of claim 1 wherein the main support comprises a substantially flexible material.

5. The apparatus of claim 1 wherein the medium dispensing assembly comprises a substantially flexible material.

6. The apparatus of claim 5 wherein the medium dispensing assembly comprises a return mechanism.

7. The apparatus of claim 6 wherein the return mechanism is constructed from a substantially compressible and substantially expandable material.

8. The apparatus of claim 5 wherein the medium dispensing assembly comprises vents.

9. The apparatus of claim 1 wherein the medium dispensing assembly comprises a solid material.

10. The apparatus of claim 9 wherein the medium dispensing assembly comprises an interior chamber having outlets, a compression device and a return component.

11. The apparatus of claim 10 wherein the medium dispensing assembly is connected to the first substantially planar surface in a recessed feature.

12. The apparatus of claim 1 wherein the second one-way conduit is contained within features of the first substantially planar surface.

13. The apparatus of claim 1 wherein the first substantially planar surface comprises geometric features for the second substantially planar surface and the main support.

* * * * *